US005665003A

United States Patent [19]

LeBeau

[11] Patent Number: 5,665,003

[45] Date of Patent: Sep. 9, 1997

[54] POOL STICK

[76] Inventor: Robert LeBeau, 607 Travis Blvd., Fairfield, Calif. 94533

[21] Appl. No.: 639,473

[22] Filed: Apr. 29, 1996

[51] Int. Cl.[6] ..... B29C 43/18

[52] U.S. Cl. ..... 473/44

[58] Field of Search ..... 473/44, 45

[56] References Cited

U.S. PATENT DOCUMENTS 132,054 10/1872 Coan ..... 473/44

672,646 4/1901 Mereness ..... 473/44

1,554,508 9/1925 Kaiser ..... 473/44

1,560,456 11/1925 Wolpert ..... 473/44

*Primary Examiner*—Theatrice Brown

*Attorney, Agent, or Firm*—William S. Bernheim

[57] ABSTRACT

The invention is a pool stick in which the slide portion has a triangular cross-section tapering toward the tip.

4 Claims, 1 Drawing Sheet

POOL STICK

BACKGROUND OF THE INVENTION

1. Field of the Invention

This invention relates to a specially designed pool stick shaft for playing pool and billiard table games providing better shooting control.

2. Description of the Prior Art

Pool and billiard tables involve games in which a stick is used by a person to propel a round ball about a flat table. Victory in the various games goes to the person most skilled in controlling the direction, speed and spin given to a ball upon being hit by the stick.

The typical pool stick is a four foot long circular stick. From about midway along the length of the stick, the stick is circular in cross-section and tapers toward a tip which is used to strike a ball. This half of the stick is referred to as the slide portion. From about the midway point in the opposite direction the stick is referred to as the grip portion and has a relatively constant circular cross-section and provides a gripping surface. To strike a ball with the stick typically employs both hands. A first hand is placed back from the ball to be hit in line with the direction the ball is to be sent. This hand forms a guide for the stick. The tapered slide portion of the stick is placed to slide in a V formed between the thumb and index finger. The second hand grips the grip portion on the stick and is used to control the point and also the direction and speed with which the stick strikes the ball.

Many efforts have been made to improve the grip portion to allow better control. Many efforts have been made to the tapered portion for a similar reason to affect the ease and predictability in which the tapered portion moves through the first hand. Many of these efforts have been directed to the finish applied to the pool stick.

Better control translates to better play.

OBJECTS OF THE INVENTION

Accordingly, it is an object of this invention to provide a new pool stick providing means for better control over forward motion.

Another object is a new pool stick which helps the novice, occasional player, and expert player have a truer forward stroke.

It is a further object of this invention to provide a new shape for the tapered portion of pool stick which gives the player better control and feel during the stroke.

Other objectives, advantages and novel features of the invention will become apparent to those skilled in the art upon examination of the invention and the accompanying drawings.

SUMMARY OF THE INVENTION

BRIEF DESCRIPTION OF THE FIGURES

The following detailed description, taken in conjuction with the accompanying drawings, illustrates a preferred embodiment of the invention. The drawings are.

DETAILED DESCRIPTION OF A PREFERRED EMBODIMENT

Figure 1A:
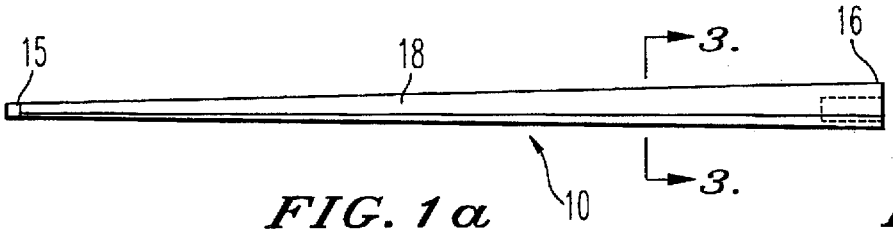
FIG. 1 is a side view of the tapered portion of a pool stick not to scale in accordance with the invention.
Figure 1B:
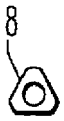
Figure 2A:
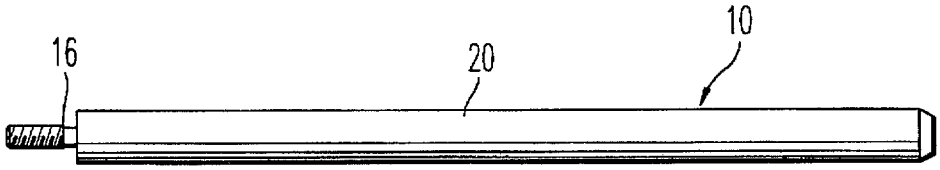
FIG. 2 is a side view of the grip portion of a pool stick not to scale in accordance with the invention.
Figure 2B:
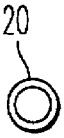

FIGS. 1 and 2 show a pool shaft 10 in accordance with the invention. The pool stick 10 is typically two parts which are screwed together and when assembled is approximately 60 inches in length but length is not critical. The use of two parts facilitates transport of the stick 10 from one venue to another in carrying cases. A first end includes a resilent tip 15, typically made of leather, plastic, or imitation leather, which actually makes contact with a cue ball during play. The tip 15 is circular with a diameter of about ⅜ of an inch. Chalk is typically applied for non slip contact when the tip contacts the cue ball.

Figure 3:
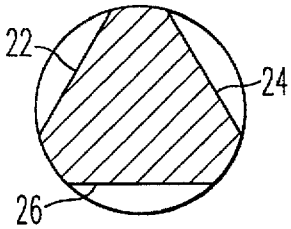
FIG. 3 is a cross-sectional view of the pool stick of FIG. 1 not to scale.
Figure 4:
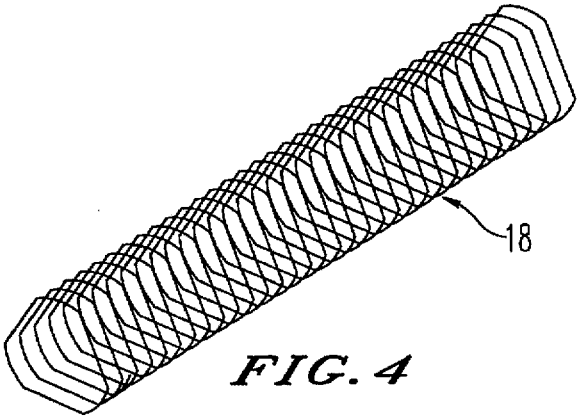
FIG. 4 is a not to scale skeletal prospective view of a portion of the tapered portion of FIG. 1.

From a point 16 about midway along the assembled length of the stick, the stick is circular in cross-section and tappers toward the tip 15. This half of the stick is referred to as the slide portion or stroke tapered zone 18. From about the midway point 16 in the opposite direction, the stick in FIG. 3 is referred to as the grip portion 20 and has a relatively constant circular cross-section and provides a gripping surface. This invention relates to the slide portion 18. The cross section as shown in FIG. 3 of the slide portion 18 is triangular with the tips of the angles truncated by rounding. The truncated angles better fit the V-shape between the thumb and index finger along which the stick 10 is slid when moved to strike a ball. Better fit translates to better and truer control of the stick which in turn leads to better play. This is particularly true with beginning, novice, and expert players.

To achieve the inventive cross section, a typical stick having a circular tapered stick can be shaved on three sides to have three planar surfaces 22, 24 and 26 as shown in FIG. 3, which would intersect at an imagery 60° angle.

I claim:

1. A pool cue for striking and propelling a pool ball on the playing surface of a pool or billiard table, said pool cue comprising:

an elongated body tapering from a first end to a second end, said first end having a larger transverse dimension than said second end; said body having a handle section and a slide section, said handle section extending from said first end to substantially midway the length of said elongated body and said slide section extending from substantially midway said elongated body to said second end;

said handle section having a substantially circular crossection along its length and said slide section having a substantially triangular crossection along its length;

said second end having a substantially resilient ball striking cue tip attached thereto for contacting a ball during game play.

2. The pool cue as defined in claim 1 wherein, said triangular crossection has planar sides and the angle between connecting sides is substantially sixty (6) degrees.

3. The pool cue as defined in claim 1 wherein, said resilient cue tip is selected from the group leather, plastic or imitation leather.

4. The pool cue as defined in claim 1 wherein, said handle section and said slide section are releasably connected by connecting means.

* * * * *